US007135966B2

(12) United States Patent
Becattini

(10) Patent No.: US 7,135,966 B2
(45) Date of Patent: Nov. 14, 2006

(54) LIGHTING INSTALLATION WITH REGULATION OF LIGHT EMISSION DEVICES

(75) Inventor: Andrea Becattini, Arezzo (IT)

(73) Assignee: Magnetek, S.p.A., Arezzo (IT)

( * ) Notice: Subject to any disclaimer, the term of this patent is extended or adjusted under 35 U.S.C. 154(b) by 87 days.

(21) Appl. No.: 10/824,770

(22) Filed: Apr. 15, 2004

(65) Prior Publication Data

US 2005/0231125 A1 Oct. 20, 2005

(51) Int. Cl.
*G08B 1/00* (2006.01)

(52) U.S. Cl. ..... 340/531; 340/531; 340/3.1; 315/294

(58) Field of Classification Search ..... 340/531, 340/506, 533, 635, 3.1; 315/294, 312, 318
See application file for complete search history.

(56) References Cited

U.S. PATENT DOCUMENTS

| | | | | |
|---|---|---|---|---|
| 4,200,862 A | 4/1980 | Campbell | 340/310 |
| 4,628,440 A | 12/1986 | Thompson | 364/140 |
| 5,059,871 A * | 10/1991 | Pearlman et al. | 315/316 |
| 8,079,139 | 8/1994 | Osamu | |
| 5,471,119 A * | 11/1995 | Ranganath et al. | 315/307 |
| 5,491,463 A | 2/1996 | Sargeant et al. | 340/310 |
| 5,811,942 A * | 9/1998 | Pedretti | 315/312 |
| 6,388,396 B1 * | 5/2002 | Katyl et al. | 315/294 |
| 6,400,103 B1 * | 6/2002 | Adamson | 315/292 |
| 2000/0043799 | 2/2000 | Katsuhiro | |
| 2000/0048969 | 2/2000 | Takakazu | |
| 2003/0046417 A1 | 3/2003 | Toru | |
| 2004/0122930 A1 * | 6/2004 | Pasternak | 709/223 |

OTHER PUBLICATIONS

U.S. Appl. No. 10/234,142, filed Sep. 2, 1998, Takahashi Hideo.

* cited by examiner

*Primary Examiner*—Daryl C Pope
(74) *Attorney, Agent, or Firm*—Waddey & Patterson; Mark J. Patterson

(57) ABSTRACT

The lighting installation comprises an electrical power supply line (3) and at least one lighting device (21A; 21B; 21C) with controllable light emission, connected to said electrical power supply line (3). Each lighting device is associated with a control unit (25A, 25B, 25C) comprising a device (30) for receiving data transmitted along the electrical power supply line (3) and devices (41; 60) for generating a light emission regulation signal. The electrical power supply line is connected to a controller (27) with a means (83) of transmitting data toward the control unit (25A, 25B, 25C). Additionally, the controller is programmed to send at least one data element to the control unit for regulating the emission of the corresponding lighting device.

36 Claims, 4 Drawing Sheets

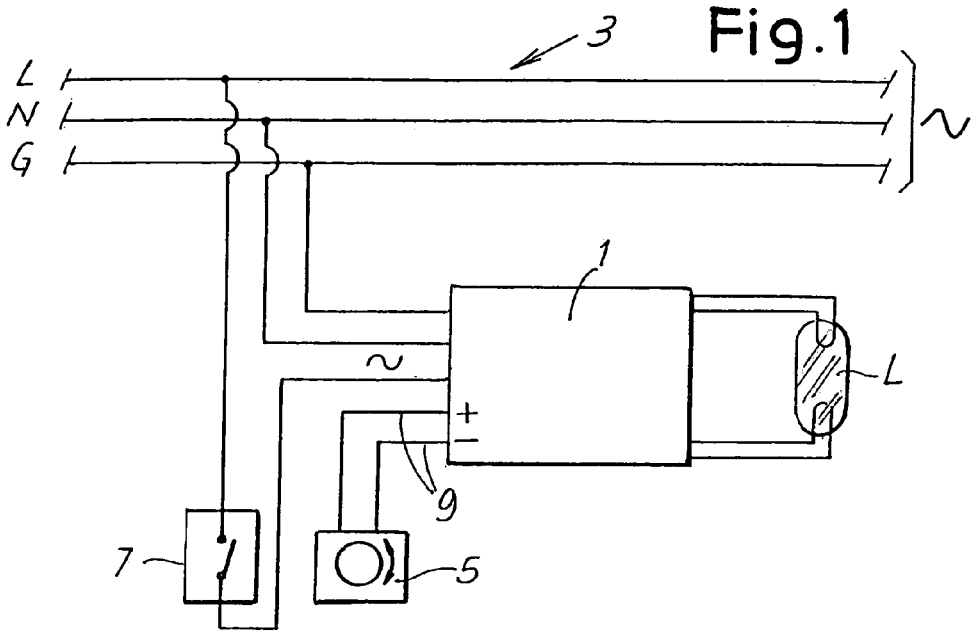
(STATE OF THE ART)
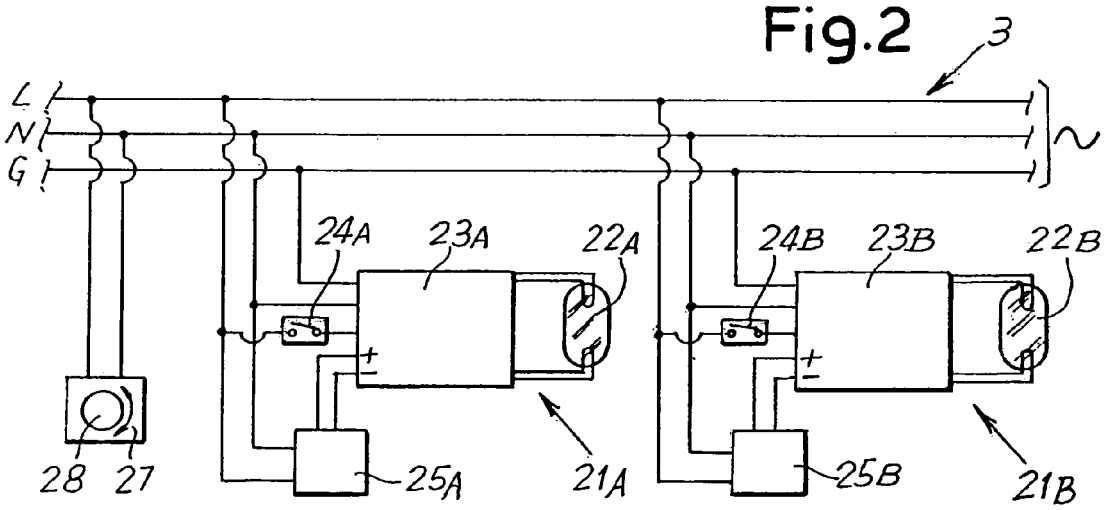

LIGHTING INSTALLATION WITH REGULATION OF LIGHT EMISSION DEVICES

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a lighting system, for example a lighting system for domestic or work premises, but also for public places, hotel or industrial buildings, urban centers, streets, and generally for environments in which it is useful or necessary to provide lamps or lighting fittings which have a light intensity regulation function, or which in other words are "dimmable".

Lamps known as "dimmable", in other words those provided with regulators of their light emission, are used increasingly often for lighting many environments, particularly domestic and work environments.

Lamps fitted with these devices can be regulated in such a way as to vary the light intensity according to the requirements of the user and/or the ambient light, for example the light from a window. Typically, dimmable ballasts, in other words ballasts containing brightness regulation circuits, are provided for regulating the light emission of HID lamps or other lamps supplied through ballasts. These ballasts require a brightness regulation signal, typically a low-voltage signal at 0–10 V, at their inputs, in addition to the electrical power network voltage. They have low-voltage control terminals, across which a potentiometer or other device for regulating the dimming signal is connected.

Devices for regulating the emission of lamps are known and are produced by many companies in this field. An example of a device of this type is the regulator produced and distributed by Osram, Germany, under the brand name Quicktronic®.

A very simple installation circuit for these devices is shown in FIG. 1. The number 1 indicates a dimmable ballast for supplying a lamp 2. The ballast is connected to the electrical power supply line 3, shown schematically as a live line L, a neutral line N and a ground line G. The number 5 indicates a potentiometer which serves to control the low-voltage signal for regulating the light emission of the lamp 2. A switch 7 is also provided for switching the lamp on and off. The switch 7 and the potentiometer 5 must be located in a position that is easily accessible to the user, and can, for example, be placed together in a single box.

Clearly, when a conventional lamp is to be replaced with a lighting fitting provided with a brightness regulator, an engineering operation is required. This is because the dimmable ballast 1 and the lamp form a single assembly which can be simply substituted for the conventional fixed emission lamp, and therefore the connections to the live line L, the neutral N and the ground G of the line 3 can be made easily without any special operation, leaving the switch 7 in the same position as the switch of the original lamp. On the other hand, the installation of the potentiometer 5 requires the installation of a dedicated electrical line 9 for the dimming signal.

Then this operation has to be carried out in an apartment or in a workplace, it will cause considerable problems and inconveniences, in addition to the costs due to this operation. Even when the use of a dimmable lamp is specified in a newly produced installation, the necessity of providing two connection lines (to the electrical power supply and to the potentiometer) complicates the installation.

If the installation comprises a plurality of lamps with regulation of the light emission, it is necessary to provide a plurality of potentiometers and consequently a plurality of lines 9, unless only a single potentiometer is used, in which case it will not be possible to regulate the light emission of the various lamps independently of each other. This evidently limits the flexibility of use.

Moreover, while it is easy to provide a plurality of on-off switches 7 at different points of a single environment or apartment, it is difficult to be able to regulate the light emission from a plurality of dispersed points.

In the lighting of public places, urban centers, highways and the like, there arises a similar problem of reducing the light flux of lamps in the middle of the night, in order to save energy. At present, this is done by reducing the supply voltage in the electrical supply network of the various lighting fittings. Essentially, the electrical power supply line of one or more lighting units includes a flux regulator, which receives at its input electrical energy at the normal power network voltage, typically 230 V, and has its output connected to the power supply line of the lighting units. The output voltage is controllable. When full illumination is required, the output voltage from the regulator is 230 V, while it is reduced in the middle of the night, typically to 180 V, thus reducing the light emission of the lamps supplied through the regulator.

This system has considerable drawbacks. This is because the power supply line of the lighting units is frequently very extended and therefore considerable losses of load occur in the line, especially when the voltage is reduced. The discharge lamps used for this type of application cannot remain illuminated if the supply voltage falls below a certain minimum value. In many situations, therefore, the lighting units farthest from the flux regulator, whose terminals receive a voltage which is lower than that at the output of the flux regulator, due to losses in the supply line, cannot remain illuminated.

BRIEF SUMMARY OF THE INVENTION

The object of the present invention is to provide an installation which overcomes the problems of the prior art described above.

According to one specific aspect, the object of a particular embodiment of the invention is to provide an installation which enables the user to easily regulate the light emission of one or more lighting fittings, particularly in a closed environment.

According to a different aspect, the object of a particular embodiment is to provide an installation which permits easy regulation of the luminous flux in a street lighting installation, for urban centers for example, to reduce the luminous flux during the night.

Essentially, the invention provides a lighting installation comprising an electrical power supply line and at least one lighting device with controllable light emission, connected to said electrical power supply line, wherein the lighting device is associated with a control unit comprising a device for receiving data transmitted along the electrical power supply line and devices for generating a light emission regulation signal; the electrical power supply line is connected to a controller with a means of transmitting data toward the control unit; and the controller is programmed to send at least one command to the control unit for regulating the emission of the corresponding lighting device.

In particular, when the installation is intended for use in a closed environment, whether public or industrial, where the user must be able to manually regulate the light emission of the lighting device or devices associated with a controller, the controller is provided with a user interface for modifying at least one control variable, according to which said regulation command is generated.

As is shown clearly by the description of some examples of embodiment, this configuration makes it possible to command the regulation of the light emission, in other words to supply the dimming command, to the lamp of one or more lighting devices through a controller located at any desired position in the electrical power supply network of the installation. It is therefore possible to replace any conventional lamp with a dimmable lamp to whose ballast (or other power supply circuit containing a light emission regulation system) the dimming signal is sent by carrier frequency transmission through the electrical power supply circuit. No auxiliary cables need to be laid. Even in the case of a new installation, the design and construction of the installation is simplified and it becomes possible to provide a multiplicity of light intensity regulation points for the various lighting units without the need to lay a large number of cables.

In one practical embodiment, the controller and the various control units associated with the various lighting devices are provided with modems of the PLM (Power Line Modem) type, to communicate with each other by carrier frequency transmission. Although in the simplest embodiment the installation requires data communication from the controller to the control unit, a configuration using PLMs permits bidirectional data exchange. This can be useful for various purposes, for example for additionally communicating to a controller the conditions of any fault or malfunction of the individual lighting devices.

In a practical embodiment of the invention, the lighting device or each lighting device comprises a ballast, or more generally an electrical power supply circuit, with a light intensity regulator for at least one corresponding lamp; the ballast has electrical power supply terminals and regulation terminals for a light emission regulation signal, said regulation terminals being connected to said control unit.

One or more on-off switches can be provided in the connection between the power supply ballast and the electrical power network for switching each lighting device on and off. However, in a particularly advantageous embodiment of the invention, the function of switching on and off is made to be carried out directly by means of the control unit of each lighting device and the controller connected to the electrical power network. In this case, the controller is programmed and can be commanded so that it also sends an on-off command to the control unit of the lighting device or devices. The control unit, in this case, advantageously comprises on-off switching means controlled by the command sent from the controller. In this case, the power supply ballast of the lamp or lamps of each lighting device can be connected to the control unit by means of electrical power supply terminals and by means of said regulation terminals. The control unit, in turn, has terminals for connection to the electrical power supply line and terminals for the electrical power supply of the lamp's power supply device (ballast).

In a different embodiment of the invention, the controller is programmed to cause a reduction of the luminous flux of the lighting devices connected to the power supply line in accordance with parameters which are not set by a user of the lighting installation, but are stored during programming and/or transmitted, for example by a telephone line or a GSM or other system, to said controller. In this case, the installation is particularly suitable for regulating the luminous flux in an urban center. For this purpose, the processor of the controller can be simply programmed to send a luminous flux reduction signal to the individual lighting devices according to a predetermined schedule. The control units receiving the command will then generate a corresponding dimming signal. Provision can also be made to reduce the luminous flux in only some of the lighting devices and not in others, for example according to the presence or absence of areas with a risk of criminal activity, or areas which contain restaurant, cultural or recreational facilities used at night and which therefore require bright lighting even in the middle of the night. In this case, the controller sends instructions directed to the individual devices, with a request for reduction of the luminous flux of only some of these.

With a system of this type, the drawbacks of conventional flux regulators are overcome, since each lighting device is always supplied at the network voltage (e.g. 230 V), and the luminous flux is regulated by a dimming signal sent to the dimmable ballast or other electronic device for controlling the light emission. All the lighting units are switched on correctly, regardless of any losses of load in the power supply network. Furthermore, the luminous flux regulation can be set differentially for the different lighting devices of a single network, without the need to segment the network itself.

According to a different aspect, the invention relates to a control unit for a lighting device with controllable light emission, which comprises, in combination: terminals for connection to an electrical power supply line; a device for receiving data transmitted along said electrical power supply line; regulation terminals for a light emission regulation signal; and devices connected to said regulation terminal, for generating a light emission regulation signal for said lighting device.

According to yet another aspect, the invention relates to a controller for a lighting installation comprising lighting devices with light emission regulation, comprising: terminals for connection to an electrical power supply line; a device for transmitting data along said electrical power supply line; and a microprocessor and if necessary a user interface for transmitting data along said power supply line toward lighting devices supplied from said electrical power supply line.

Further advantageous characteristics of the installation, the controller and the control unit according to the invention are indicated in the attached dependent claims and are described below with reference to non-restrictive examples of embodiment.

BRIEF DESCRIPTION OF THE SEVERAL VIEWS OF THE DRAWINGS

FIG. 1 shows a connection diagram of a lighting device with regulation of the light intensity, according to the prior art;

FIG. 2 shows a diagram of a first embodiment of an installation according to the invention;

DETAILED DESCRIPTION OF THE INVENTION

Figure 3:
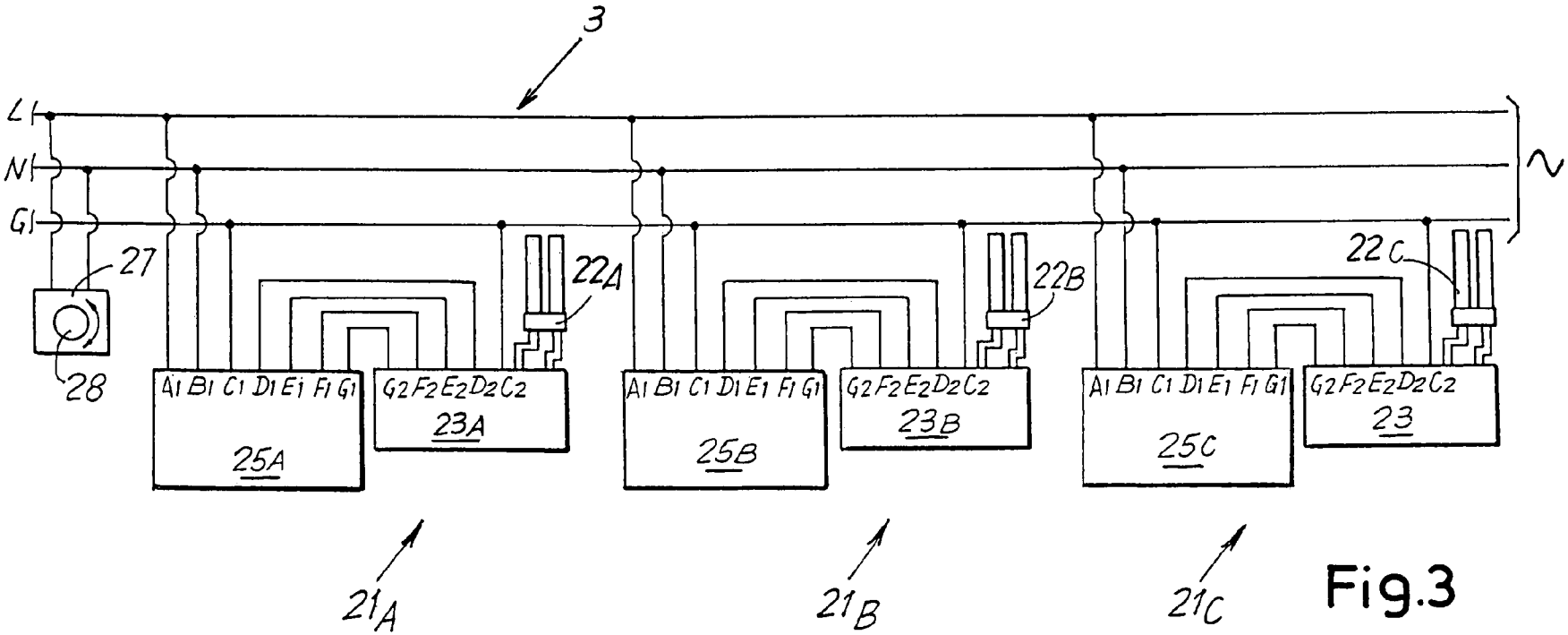
FIG. 3 shows a diagram of a second embodiment of an installation according to the invention.

FIG. 2 shows a portion of a lighting installation, for example in an apartment or the like, produced according to a first embodiment of the invention. The number 3 indicates the electrical power supply line, the live, neutral and ground lines of which are indicated by L, N and G. The numbers 21A and 21B indicate the whole of two lighting devices, each comprising a corresponding lamp 22A, 22B. Each lamp is supplied from a dimmable ballast 23A, 23B of a known type which is not described in detail. Each dimmable ballast has terminals for connection to the live line L and to the neutral N for the electrical power supply to the lamp, and a terminal for connection to the ground G. An on-off switch 24A, 24B is provided for each lighting device 21A, 21B in the connection to the live line L of the electrical power supply line 3. Additionally, each ballast has, in a known way, regulation connectors or terminals, for a low-voltage signal for regulating the intensity of light emission of the lamp 22A, 22B.

As shown in the figure, the regulation terminals for the light intensity regulation signal of each ballast 23A, 23B are connected to a corresponding control unit 25A, 25B associated with the lighting device 21A and 21B respectively. Each control unit, in turn, has terminals or connectors for connection to the power supply line 3. A controller 27 is also connected to the latter, this controller being single in the illustrated example, although the possibility of providing a plurality of controllers on the same line 3 is not excluded.

Although this is not shown in the diagram of FIG. 2, the ballast 23A, 23B and the control unit 25A, 25B of each lighting device 21A, 21B are housed near the lamp and if necessary in an overhead light fixture containing the lamp. The ballast can be contained in the base of the lamp, in a known arrangement. Conversely, the switch 24A, 24B of each lighting device 21A, 21B can also be positioned at a distance from the lamp and if necessary a plurality of switches can be provided to switch a single lamp on and off, in circuit arrangements known to those skilled in the art. The controller 27 can be placed at any suitable point, easily accessible to the user, of the electrical power supply network. When the installation is fitted in an apartment for example, different lighting devices can be provided in different rooms, and in each room one or more switches for each lamp and one or more controllers 27 can be provided at suitable points.

The controller 27 has a user interface, which for example can be a small wheel 28 or other rotatable element for example, as typically used for regulating the light intensity by means of potentiometers in conventional devices. In this case, however, the potentiometer associated with the wheel 28 is not used to directly modulate the low-voltage signal applied to the low-voltage regulation terminals of the ballast 23A or 23B. Instead, it is used to supply to a microprocessor or other suitable control circuit of the controller 27 a signal which is used by said controller for transmitting a data element along the electrical power supply line 3, by means of a PLM (Power Line Modem), toward one or other of the control units 25A, 25B connected to the line. PLMs are known devices. A suitable component could be an ST7537 or ST7537HS1 circuit made by ST Microelectronics, a TDA5051 or TDA5051A circuit made by Philips, or another equivalent device. The signal sent by the PLM along the line 3 can be frequency- or amplitude-modulated, according to the design chosen and the type of modem used.

The control unit 25A, 25B of each lighting device 21A, 21B has a similar PLM modem, as described more fully below, which receives the encoded data in the carrier frequency signal transmitted by the central unit. The control unit uses this signal to generate, by means of a microprocessor or other logic system, a corresponding low-voltage signal which is applied to the light emission regulation terminals of the ballast 23A or 23B.

In practice, therefore, the light intensity regulation signal is not generated by the user by means of a potentiometer directly connected to the corresponding ballast, but by the controller 27, and is transmitted by the latter along the electrical power supply line, thus making it unnecessary to have an additional cable running from each ballast to the potentiometer, such as that indicated by 5 in FIG. 1.

If all the ballasts are to be controlled by the same regulation signal, in other words if the light emission of all the lamps is to be regulated simultaneously and in the same way, only one controller 27, without any special arrangements, is sufficient to provide this function. Alternatively, a plurality of identical controllers, located at different points for the sake of convenience, can be used as an alternative to provide the same function. Each of these can receive through its PLM modem data relating to a change in the regulation provided by any other controller, in such a way that the different controllers are always aware of the existing state of emission of the different lamps 22A, 22B. However, this is not essential, since each controller can be limited to the sending of a command to increase or decrease the light intensity, without any need to know the existing instantaneous state of operation of the lamp.

If a number of controllers 27 equal to or greater than the number of ballasts (or the number of groups of ballasts to be controlled simultaneously by each regulation command) is connected to the electrical power supply line 3, each of the controllers will be programmed to send a regulation command signal characterized by a recognition code (by means of a suitable transmission protocol). Thus all the control units 25A, 25B connected to a single supply line 3 always receive all the commands sent from any of the various controllers. The recognition code enables each control unit 25A to discriminate between the commands addressed to it and those addressed to the other controllers.

Conversely, if a single controller 27 is required to control a plurality of lighting devices 21A, 21B (for example, if the single controller 27 is to control the two devices 21A, 21B shown in the example of FIG. 2), the controller 27 is programmed to enable the transmission of regulation command signals which are characterized at different times by recognition codes, which can be input by means of a simple user interface, to control one or other of the lighting devices at different times. In this case also, it is possible to provide a plurality of controllers suitably located along the supply line 3, each of these controllers being able to command (by signals characterized by a recognition code selected by the user) either one of the ballasts 23A, 23B as required. Also in this case each controller may receive information on the regulation provided by the other controller(s), such that all the controllers are always synchronized. However, this synchronization is not essential if the signal generated contains a simple command such as "increase intensity" or "decrease intensity". This is because, in such a case, it is not necessary for the controller which generates the command to know the intensity of emission of the lamp. The control units or the ballasts will contain suitable circuits for limiting the emission of the corresponding lamps.

When the controller 27 is required to control a plurality of lighting devices 21A, 21B independently, it may have, for example, a plurality of wheels 28, one for each lighting device or for each group of lighting devices to be controlled simultaneously. Otherwise, a plurality of pairs of buttons for increasing and decreasing the lighting can be provided, one pair being assigned to each lighting device or group of devices. Alternatively, additional control elements can be provided, for example a keypad for inputting a code corresponding to the lighting device (or to the group of lighting devices) to be regulated by the subsequent intensity regulation command, entered by means of a single wheel 27.

Regardless of the type of interface used, a suitable and easily produced circuit will serve to transmit the commands from the user interface to the microprocessor of the controller which will then transmit a corresponding command by means of the PLM modem.

In the example described with reference to FIG. 2, each lighting device must have at least one on-off switch 24A, 24B. However, the present invention makes it possible to eliminate this requirement as well, by grouping all the functions (of on-off switching and emission intensity regulation) in the controller 27 and in the control units 25A, 25B. Thus the lighting installation is further simplified and it becomes extremely simple to provide a large number of control points for switching the various lighting devices on and off, especially since these control points can be added simply by connecting a controller to any electrical outlet of the electrical installation of an apartment.

A simplified diagram of an improved embodiment of this type is shown in FIG. 3, where identical numbers indicate parts identical or equivalent to those of FIG. 2. In this case, three lighting devices are shown, the third being characterized by the same reference numbers as the other two, followed by the letter C. In this case, each control unit 25A, 25B, 25C has seven terminals, which are indicated for convenience by A1, B1, C1, D1, E1, F1 and G1 in the figure. The terminals A1, B1 and C1 are connected respectively to the live, neutral and ground conductors L, N and G of the electrical power line 3. The terminals D1 and E1 are electrical power supply outlet terminals and are connected to two corresponding electrical power supply terminals D2 and E2 of the respective ballast 23A, 23B or 23C. The two terminals F1 and G1 are connected to the terminals F2 and G2 of the ballast, to which the signal for regulating the emission intensity of the corresponding lamp is sent.

In this case, the controller 27, provided with suitable user interface means, again indicated by 28, transmits along the line 3 by means of its PLM modem a signal which contains an on-off switching command for the corresponding selected lighting device if required, in addition to a command for regulating the light intensity. As will be described with reference to FIG. 4, each control unit 25A, 25B and 25C has incorporated on-off switching means, controlled by the carrier frequency transmission signal sent from the controller 27. As in the preceding case, the control unit 25A, 25B and 25C of each lighting device 21A, 21B and 21C is housed, for example, in the overhead light fixture containing the lamp, so that each lighting device requires only connections to the live and neutral conductors of the line 3, as well as to the ground. The on-off switching and dimming commands of the various lighting devices can be produced by one or more controllers 27 located at any point of the installation, provided that they are connected to the power supply line.

The description provided with reference to FIG. 2, in respect of the method of sending the on-off switching and emission intensity regulation commands from various controllers to the various lighting devices, is applicable to the present case.

Figure 4:
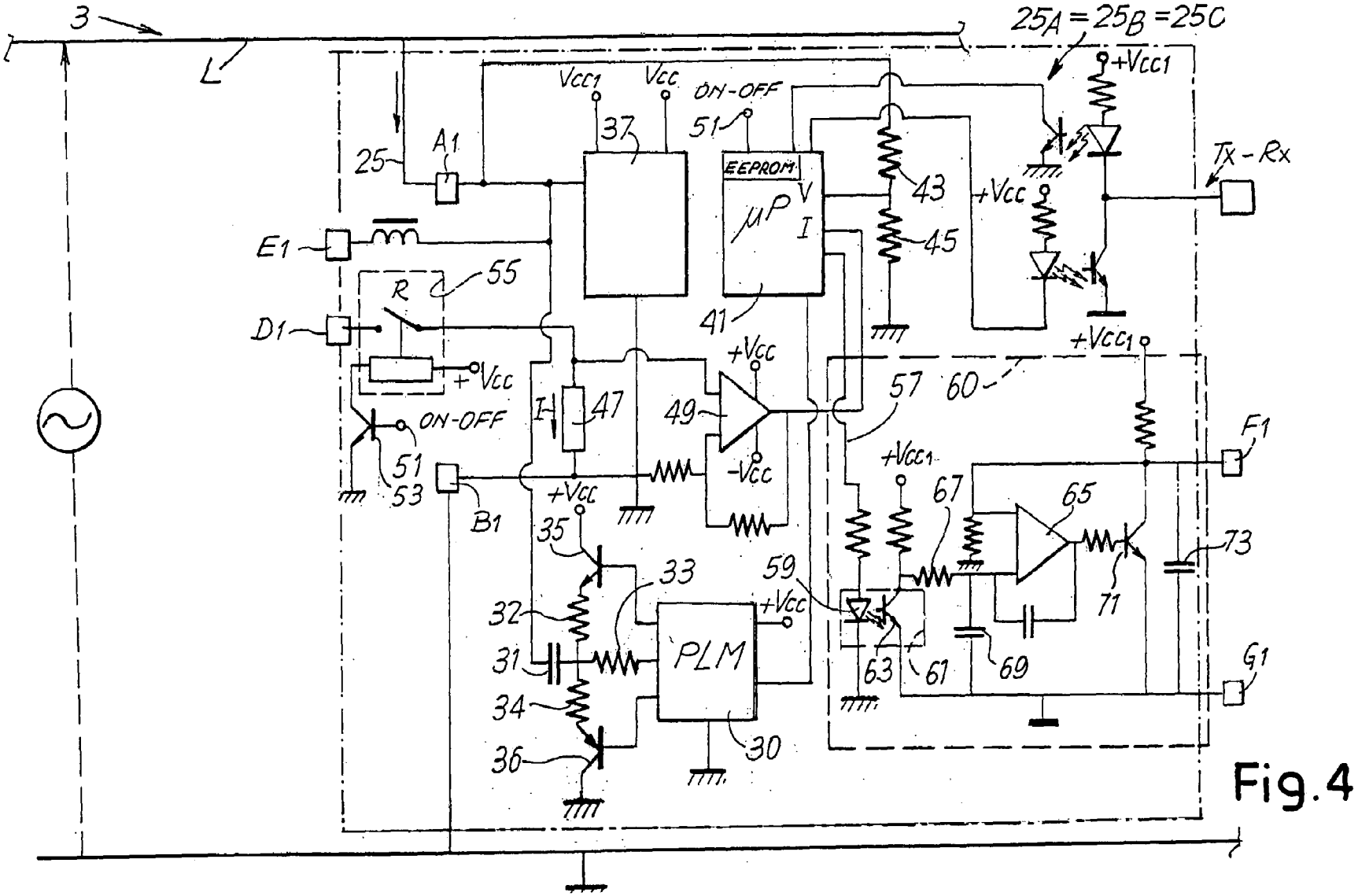
FIG. 4 shows an electrical circuit diagram of a control unit associated with a lighting device.

FIG. 4 shows an electrical circuit diagram of any one of the control units 25A–25C in the embodiment of FIG. 3. The terminals for connection to the line 3 and to the ballast 23 (not shown) are again indicated by the references A1, B1, C1, D1, E1, F1 and G1. The number 30 indicates the PLM modem which receives the data containing the on-off switching and regulation commands from the line 3. In the illustrated example, the modem 30 is connected to the live conductor LF of the power supply line 3 by means of a capacitor 31 and a network comprising three resistors 32, 33 and 34 and two transistors 35 and 36. The configuration of the connection between the PLM and the electrical power supply line does not require a detailed description, since it is known to and understood by persons skilled in the art.

The number 37 indicates a 10 V power supply which supplies the components of the control unit 25 with a continuous voltage at 10 V.

The control unit also comprises a microprocessor 41 which, in this embodiment, also performs an auxiliary function of checking that the lamp is operating correctly. For this purpose, it receives at its input a voltage V proportional to the supply voltage of the ballast 23A, 23B or 23C connected to the terminals C1 and D1, through a voltage divider 43, 45. The microprocessor 41 also receives at its input a signal proportional to the current drawn by the ballast. This signal is obtained by means of a reading resistance 47 through which the drawn current I flows. The voltage drop across the terminals of the reading resistance 47 is applied to the inputs of an operational amplifier 49, whose output signal represents the signal proportional to the current I which is supplied to the microprocessor 41. The block 41 is to be understood as incorporating the analog-digital converters which enable the microprocessor to calculate digital values corresponding to the analog values of the magnitudes of voltage and current. The microprocessor calculates the power drawn by the lighting point 1B and supplies the result to the modem 30 which can transmit the corresponding information along the line 3 to the controller 27, which can be used for remotely checking that the various lighting devices are operating correctly.

Since systems with dimmable electronic reactors are provided with serial data transmission and reception lines, the microprocessor 41 can also receive the lamp voltage and current data directly from the electronic reactor, and from these data it can then derive information on the correctness of the operation of the lamp. In FIG. 4, the data transmission and reception line is indicated schematically by Tx-Rx.

The modem 30 receives from the electrical power supply line 3 the control signals for switching on and off the lighting device 21 associated with the control unit 25, and for regulating the light intensity. The modem is connected to the microprocessor 41 to communicate to the latter the data received along the line 3. An output terminal of the microprocessor 41, indicated by 51, supplies a switching signal to a switch 53, consisting of a transistor for example, to the base of which the switching signal from the terminal 51 is sent. The conducting or non-conducting state of the transistor 53 causes the switching of a relay 55 connected to the terminal D1. Consequently, the opening and closing of the switch 53 switches on and off the lighting device 21, whose ballast 23 is connected to the power supply terminals C1 and D1 of the control unit 25.

A further output 57 of the microprocessor 41 supplies a signal for regulating the intensity of emission of the lamp 22 whose ballast 23 is connected to the control unit 25. The output 57 (variable duty cycle PWM) is connected to a circuit indicated as a whole by 60 and comprising a galvanic isolation system and a circuit for generating the voltage for regulating the light emission of the corresponding lamp 22A, 22B or 22C. The circuit 60 comprises a LED 59 forming part of an optical coupler 61, whose receiver is indicated by 63. The optical coupler 61 is connected by means of an RC network, comprising a resistor 67 and a capacitor 69, to the inverting terminal of an operational amplifier 65. The output of the operational amplifier 65 drives a transistor 71, whose collector and emitter are connected to the regulation terminals F1 and G1 of the control unit 25, in parallel with a capacitor 73. Thus there is a continuous signal, proportional to the voltage at the output terminal 57 of the microprocessor, at the terminals F1 and G1, this signal being used to regulate the emission of the lamp 22 and being sent to the low-voltage regulation terminals F2 and G2, provided for the dimming function, of the ballast 23. The optical coupler 63 galvanically isolates the output of the light emission regulation signal from the electrical power supply line 3.

Figure 5:
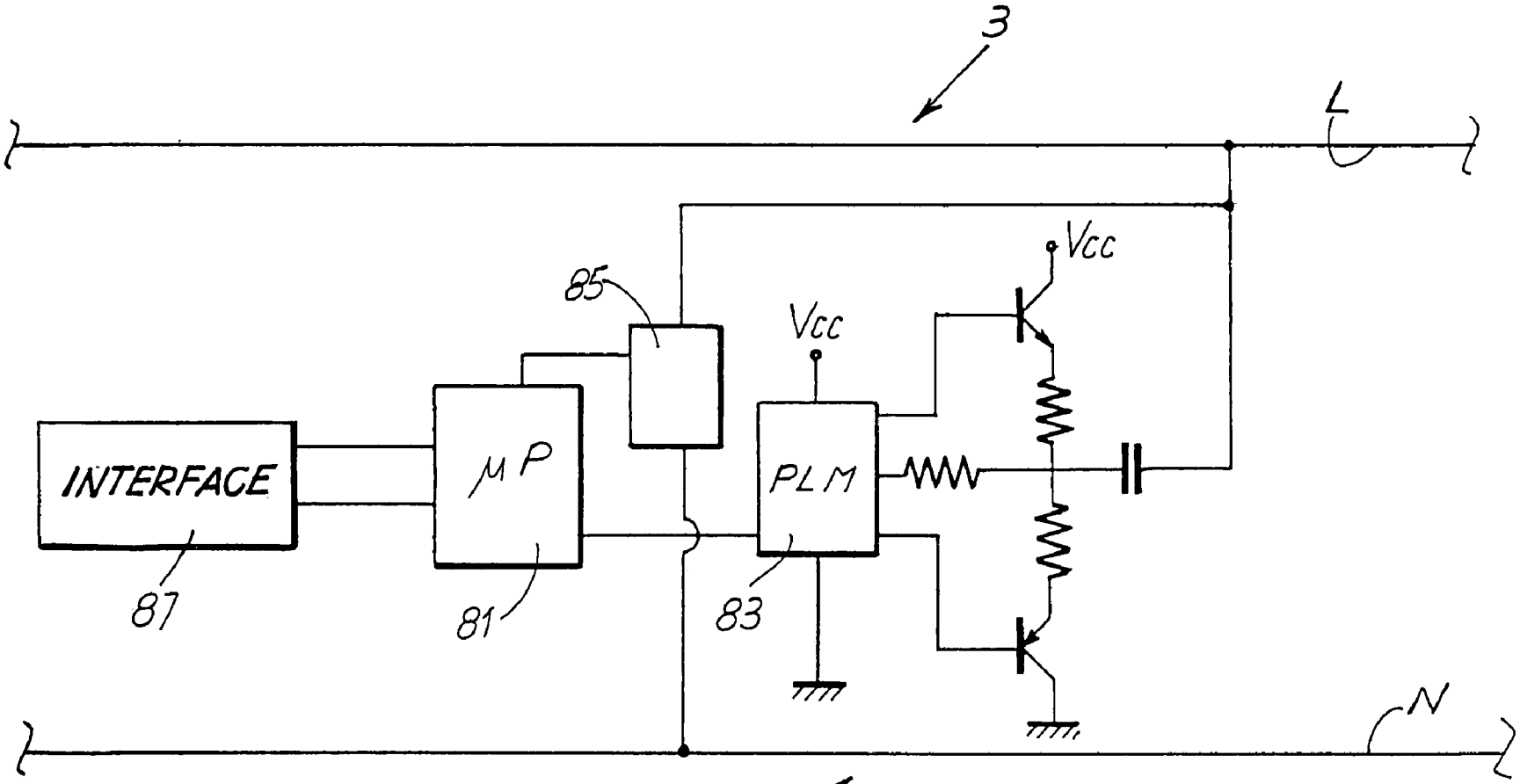
FIG. 5 shows a block diagram of the controller.

FIG. 5 is a summary block diagram of the controller 27. The controller comprises a microprocessor 81 and a PLM modem, indicated by 83, connected to the line 3 by a circuit arrangement similar to that described with reference to the modem 30 of FIG. 4. The components of the controller 27 are supplied at a continuous voltage of 10 V by a power supply 85. Finally, the number 87 indicates a user interface of any type, connected to the microprocessor 81. The interface 87 can have various configurations, according to the types of command to be sent by the controller 27. In the simplest case, the interface can be a potentiometer for varying a reference voltage used as a parameter for the regulation of the emission of the lamp of the lighting device controlled by said controller.

The above description is also applicable to the provision of public lighting systems in which the luminous flux is not regulated by the user, but programmed according to specific timetables and/or controlled by a central unit, for example a control center of the authority managing the public lighting. In this case, the lighting devices will be the lighting points of an urban lighting network, for example, and the controller 27 will have no user interface, or at least will have no interface which is easily accessible from the outside. The interface can, however, be present in a protected location to allow authorized personnel to program the microprocessor 81. Additionally, or alternatively, it is possible to provide a modem connected to a telephone line or to the mobile telephone network, to allow access to the programming of the microprocessor 81 from an operating center.

In all cases, in this configuration, the controller 27 sends commands for the reduction of the luminous flux to the various lamps at specified times, which can be modified and programmed. It can also send commands for switching on and off. Both the dimming and the on-off switching commands can be selective, in other words addressed to one or other of the various lighting devices distributed along the power supply line. For this purpose, it is simply necessary for the commands to be encoded according to a transmission protocol which contains the address of the device to which the command is addressed.

In a different embodiment, it is possible to arrange for the data on the on-off switching and/or luminous flux reduction timetable to be contained in a memory (an EEPROM for example) associated with each microprocessor 41 associated with each lighting device. In this case, the controller 27 only has to send a signal containing the current time according to its internal clock, in other words a kind of time signal, along the power supply line 3 at intervals. When the various control units 25A, 25B and 25C receive the time signal from the controller 27, they compare it with the on-off switching or luminous flux variation timetable. Each control unit then activates the command for switching on or off and/or for modifying the luminous flux, this being done in a fully synchronized way by means of the time signal. In general, therefore, the information sent by the controller along the electrical power supply line 3 can be only indirectly connected to an on-off switching or regulation command, this command being actually generated within each individual device or control unit 25A–25C. This simplifies the protocol for transmitting data along the line, but complicates the programming of the on-off switching and luminous flux regulation timetables, since this has to be carried out separately for the different devices.

Clearly, the drawing shows only one possible embodiment of the invention, which can be varied in its forms and arrangements without departure from the scope of the guiding principle of the invention. The presence of any reference numbers in the attached claims has the sole purpose of facilitating the reading of the claims with reference to the preceding description and to the attached drawings, and does not in any way limit the scope of protection defined by the claims.

Thus, although there have been described particular embodiments of the present invention of a new and useful Lighting Installation with Regulation of Light Emission Devices, it is not intended that such references be construed as limitations upon the scope of this invention except as set forth in the following claims.

What is claimed is:

1. A lighting installation for varying the light intensity of at least one light source through a power supply line comprising:

(a) a control unit comprising a data receiver or device for receiving a command along the power supply line and a microprocessor for creating a brightness regulation signal according to the command;

(b) a controller having a transmission device for transmitting the command to the control unit;

(c) a power supply circuit having a light intensity regulator for varying the light intensity of at least one light source with the brightness regulation signal; and (d) a galvanic isolation system connecting the microprocessor and the power supply circuit.

2. The lighting installation of claim 1, wherein:

(a) the microprocessor inputs an input current signal proportional to a power circuit current drawn by the power supply circuit;

(b) the microprocessor inputs an input voltage signal proportional to a power circuit voltage drawn by the power supply circuit whereby the microprocessor determines a result according to input voltage signal and the input current signal; and (c) the control unit transmits the result to the controller thereby detecting the correct operation of at least one light source.

3. The lighting installation of claim 1, further comprising:

(a) the power supply circuit having data transmission lines for transmitting an input current signal and a input voltage current signal;

(b) the microprocessor inputting the input voltage signal and the input current signal whereby the microprocessor determines a result according to input voltage signal and the input current signal; and (c) the control unit transmitting the result to the controller thereby detecting the correct operation of at least one light source.

4. A lighting installation for varying the light intensity of at least one light source through a power supply line comprising:

(a) a control unit comprising a data receiver or device for receiving data transmitted along the power supply line, a microprocessor, a light regulation circuit for generating a brightness regulation signal, and a galvanic isolation system connecting the microprocessor and the light regulation circuit thereby galvanically isolating the microprocessor and the light regulation circuit;

(b) a controller having a transmission device for transmitting a command to the control unit;

(c) the microprocessor converting the command into an output voltage whereby the light regulation circuit generates the brightness regulation signal; and (d) a power supply circuit having a light intensity regulator for varying the light intensity of at least one light source according to the brightness regulation signal, the power supply circuit further comprising regulation terminals for receiving the brightness regulation signal from the control unit.

5. The lighting installation of claim 4, wherein the galvanic isolation system comprises an optical coupler.

6. The lighting installation of claim 5, wherein the transmission device comprises a modem for transmitting and receiving data by carrier frequency transmission along the power supply line.

7. The lighting installation of claim 6, further comprising an on-off switch connecting to each light source.

8. The lighting installation of claim 7, wherein the power supply circuit further comprises electrical supply terminals connected to the power supply line, the on-off switch being connected between at least one of the electrical supply terminals and the power supply line.

9. The lighting installation of claim 7, wherein the control unit further comprises an on-off switch.

10. The lighting installation of claim 9, wherein the on-off switch comprises a transistor and a relay whereby the conducting state of the transistor causes the switching of the relay.

11. The lighting installation of claim 10, wherein the controller transmits an on-off command to the control unit for independent on-off switching of each light source.

12. The lighting installation of claim 10, wherein the control unit further comprises:

(a) power supply terminals for connection to the power supply lines;

(b) power relay terminals connecting to the power supply circuit whereby the power supply circuit connects to the power supply through the control unit; and (c) the controller transmits an on-off command to the control unit for independent on-off switching of each light source.

13. The lighting installation of claim 12, wherein at least one of the electrical power supply terminals of the power supply circuit is connected to the on-off switch of the control unit.

14. The lighting installation of claim 13, wherein the on-off switch is controlled by the microprocessor according to the on-off command received by the data receiver or device.

15. The lighting installation of claim 14, further comprising means for detecting the correct operation of at least one light source.

16. The lighting installation of claim 15, wherein the means for detecting the correct operation of at least one light source comprises:

(a) the microprocessor inputting an input current signal proportional to a power circuit current drawn by the power supply circuit;

(b) the microprocessor inputting an input voltage signal proportional to a power circuit voltage drawn by the power supply circuit whereby the microprocessor determines a result according to input voltage signal and the input current signal; and (c) the control unit transmitting the result to the controller.

17. The lighting installation of claim 15, wherein the means for detecting the correct operation of at least one light source comprises:

(a) the power supply circuit having data transmission lines for transmitting an input current signal and input voltage signal;

(b) the microprocessor inputting the input voltage signal and the input current signal whereby the microprocessor determines a result according to input voltage signal and the input current signal; and (c) the control unit transmitting the result to the controller.

18. The lighting installation of claim 17, wherein the controller further comprises a user interface for modifying at least one control variable.

19. A lighting installation for varying the light intensity of at least one light source through a power supply line comprising:

(a) a controller transmitting a time signal through the power supply line;

(b) a control unit having a microprocessor and a memory unit; and (c) the memory unit having commands for modifying at least one control variable of at least one light source arranged in a time table whereby the control unit receives the time signal and the microprocessor compares the time signal received with the time table thereby selecting an appropriate command from the timetable which modifies at least one control variable of at least one light source.

20. The lighting installation of claim 19 further comprising:

(a) a light regulation circuit for producing a brightness regulation signal when the control variable is luminous flux, the light regulation circuit is galvanically connected to the microprocessor; and (b) a power supply circuit connecting to at least one light source and receiving the brightness regulation signal thereby regulating the light emission of at least one light source.

21. The lighting installation of claim 20 further comprising an optical coupler galvanically connecting the microprocessor and the light regulation circuit.

22. The lighting installation of claim 21 further comprising an on-off switch for independently switching at least one light source when the control variable is on-off switching.

23. The lighting installation of claim 22, wherein the on-off switch is controlled by the microprocessor according to the command when the control variable is on-off switching, the command being received from the memory unit.

24. A lighting installation for varying the light intensity of a plurality of light sources through a power supply line comprising:

(a) a controller for transmitting a time signal through the power supply line;

(b) control units having a microprocessor and a memory unit, the number of control units equaling the number of light sources and each control unit connecting to one light source; and (c) the control units modifying at least one control variable for the connected light source by receiving the time signal whereby the microprocessor compares the time signal with the timetable thereby selecting the appropriate command from the timetable.

25. The lighting installation of claim 24 further comprising:

(a) light regulation circuits, each light regulation circuit corresponding to one control unit, for producing a brightness regulation signal when the control variable is luminous flux, each light regulation circuit is galvanically connected to the microprocessor within the respective control unit; and (b) power supply circuits connecting each control unit to the connected light source and receiving the brightness regulation signal thereby regulating the light emission of the connected light source.

26. The lighting installation of claim 25 further comprising optical couplers, each optical coupler corresponding to one control unit for galvanically connecting the microprocessor and the light regulation circuit.

27. The lighting installation of claim 26 further comprising on-off switches, each on-off switch associated with one control unit for independently switching the connected light source when the control variable is on-off switching.

28. The lighting installation of claim 27, wherein the on-off switches are controlled by the microprocessor within the respective control unit according to the command when the control variable is on-off switching, the command being received from the respective memory unit.

29. A lighting installation for varying the light intensity of a plurality of light sources through a power supply line comprising:

(a) a plurality of control units, each control unit having a data receiver or device for receiving data transmitted along the power supply line, a microprocessor, and an on-off switch;

(b) power supply circuits connecting to one control unit at first terminals and connected light sources at a second pair of terminal, the connected light sources being less than all of the plurality of light sources;

(c) a controller having a transmission device for transmitting an on-off command to each control unit whereby each control unit sends the on-off command to the microprocessor within the control unit; and (d) the microprocessor within each control unit independently switching the on-off switch within the control unit according to the on-off command thereby on-off switching the connected light sources.

30. A control unit for regulating the light emission of a lighting device with a comprising through a power supply line:

(a) power terminals for connection to the power supply line;

(b) a data receiver or device for receiving a receiver command transmitted along the power supply lines for controlling a control variable of the lighting device;

(c) power relay terminals for a light emission regulation signal;

(d) a microprocessor connected to the data receiver or device; and (e) a light regulation circuit for generating the light emission regulation signal at the power relay terminals, the light regulation circuit galvanically connecting to the microprocessor.

31. The control unit of claim 30 further comprising power relay terminals for transferring a supply voltage to the lighting device.

32. The control unit of claim 31 further comprising an on-off switch for independently switching the lighting device on and off.

33. The control unit of claim 32 wherein the on-off switch is controlled according to the receiver command received by the transmitter when the control variable is on-off switching.

34. The control unit of claim 32 further comprising:

(a) the receiver command being a time signal;

(b) a memory unit; and (c) the memory unit having stored commands for modifying at least one control variable of the lighting device arranged in a timetable whereby the control unit receives the receiver command and the microprocessor compares the receiver command received with the timetable thereby selecting an appropriate command from the timetable thereby modifying at least one control variable of at least one light source.

35. The control unit of claim 32 wherein the data receiver or device is a modem for transmitting and receiving the receiver command by carrier frequency transmission along the power supply line.

36. A controller for a power supply line connected to a lighting installation having lighting devices and at least one device for regulating the light emission for the lighting devices, comprising:

(a) data transmission terminals for connection to the power supply line;

(b) a transmission device for transmitting a time signal for controlling a variable of at least one lighting device along the power supply line;

(c) a microprocessor for controlling the transmission of the time signal by the transmission device along the power supply line; and (d) the microprocessor is programmed to send a time signal for independently controlling a variable of at least one light source.

* * * * *